United States Patent [19]

Janssen et al.

[11] Patent Number: 4,955,245

[45] Date of Patent: Sep. 11, 1990

[54] GAS SPRING FOR ACTUATOR

[75] Inventors: Hendrikus C. J. G. Janssen, Hengelo; Joseph H. M. Tiehuis, Delden, both of Netherlands

[73] Assignee: Holland Hellas Holding B.V., Netherlands

[21] Appl. No.: 308,448

[22] Filed: Feb. 10, 1989

[30] Foreign Application Priority Data

Feb. 11, 1988 [NL] Netherlands ..... 8800340

[51] Int. Cl.[5] ..... F15B 15/06

[52] U.S. Cl. ..... 74/109; 74/89.17; 92/134; 92/136

[58] Field of Search ..... 74/109, 89.17; 92/130 B, 134, 136

[56] References Cited

U.S. PATENT DOCUMENTS

| | | | |
|---|---|---|---|
| 2,869,861 | 1/1959 | Carlson | 74/109 X |
| 3,338,140 | 8/1967 | Sheedey | 74/89.17 X |
| 4,103,591 | 8/1978 | Reiersdal | 92/134 X |
| 4,174,656 | 11/1979 | Duffey | 92/134 |
| 4,355,566 | 10/1982 | Kaji | 92/136 |
| 4,406,599 | 9/1983 | Stephan | 74/109 X |
| 4,561,592 | 12/1985 | Fender et al. | 74/109 X |
| 4,647,003 | 3/1987 | Hilpert et al. | 92/136 X |
| 4,756,204 | 7/1988 | Wittwer et al. | 74/109 X |
| 4,759,260 | 7/1988 | Lew | 92/134 X |
| 4,794,847 | 1/1989 | Krewter et al. | 74/109 X |

*Primary Examiner*—Peter R. Brown

*Attorney, Agent, or Firm*—Watson, Cole, Grindle & Watson

[57] ABSTRACT

The invention relates to an actuator, comprising:

a cylinder, one or two pistons reciprocally movable in that cylinder one or two racks, each carried by a piston, a pinion coupled to the rack(s), an output connecting part coupled to that pinion for connecting to a device for driving, such as a butterfly valve, means for connecting to a line for medium under pressure for causing the pistons simultaneously to move towards or move away from one another, thereby causing the execution of a corresponding pivoting movement of the output connecting part, and resetting spring means for forcing the pistons into a terminal rest position.

The invention provides an actuator with the feature that the resetting spring means comprise at least one gas spring which is connected between the cylinder and a piston. The advantage of the use of a gas spring is that within relatively precise limits it delivers a constant force over a very wide area, also therefore at the end of its stroke, whereby a reliable closure of a driven valve is better assured than is the case with the use of known screw springs. A gas spring also has the advantage of being obtainable in many embodiments after relatively simple adaptations with a view to connection to a known actuator and moreover of being easy to change from outside by a simple manual operation.

11 Claims, 2 Drawing Sheets

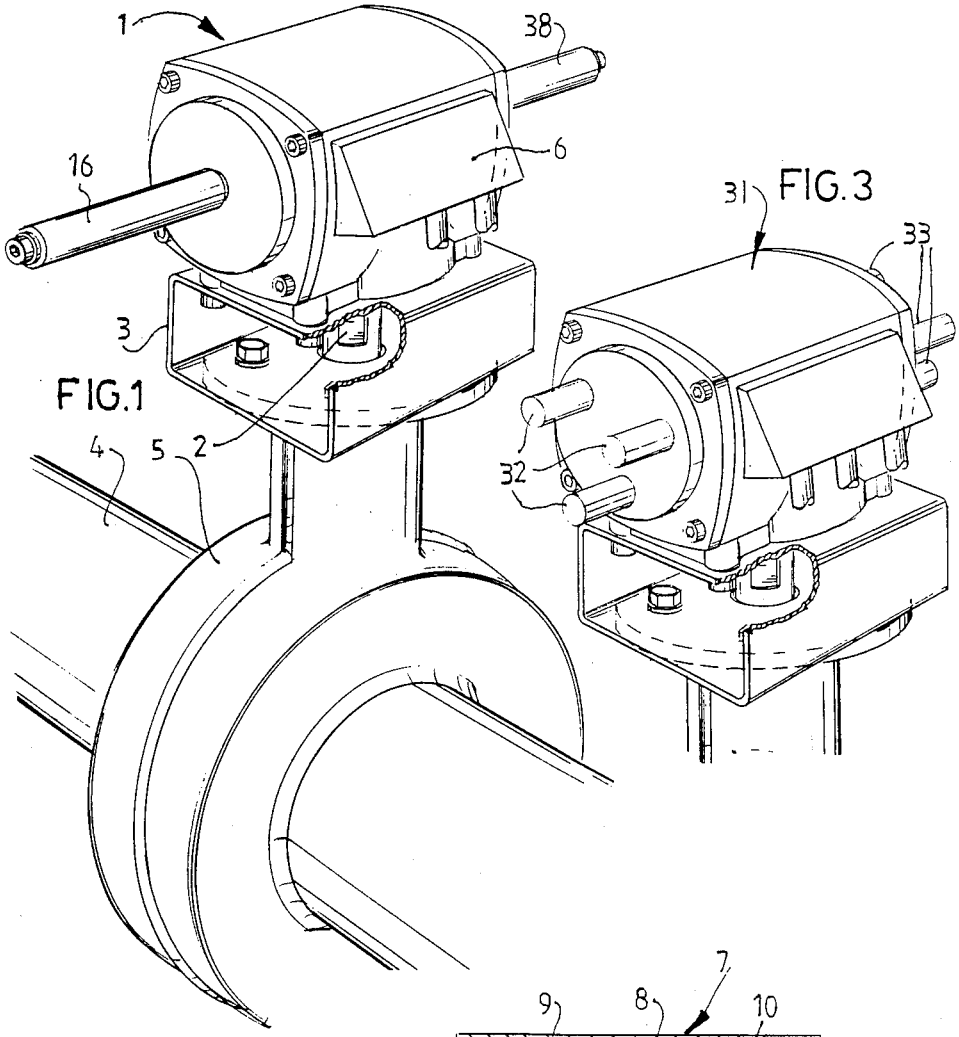
FIG.1
FIG.3
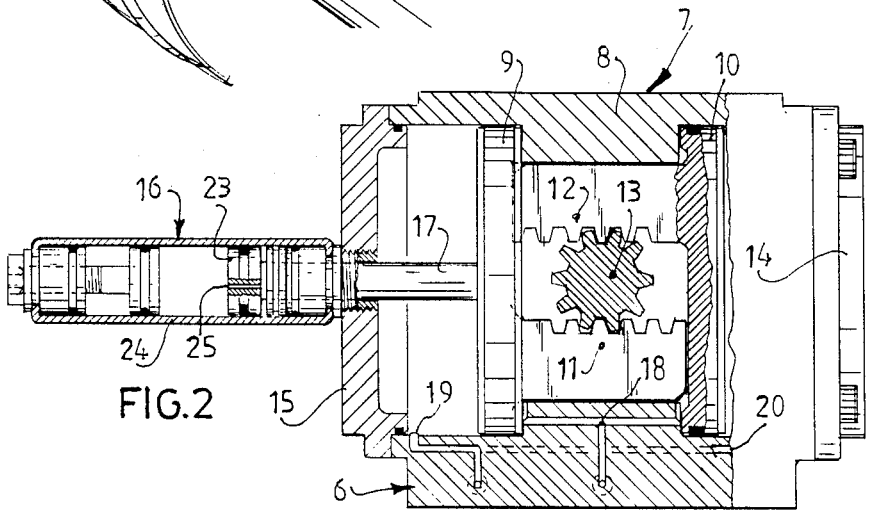
FIG.2

GAS SPRING FOR ACTUATOR

The invention relates to an actuator, comprising:

a cylinder, one or two pistons reciprocally movable in that cylinder one or two racks, each carried by a piston, a pinion coupled to the rack(s), an output connecting part coupled to that pinion for connecting to a device for driving, such as a butterfly valve, means for connecting to a line for medium under pressure for causing the pistons simultaneously to move towards or move away from one another, thereby causing the execution of a corresponding pivoting movement of the output connecting part, and resetting spring means for forcing the pistons into a terminal rest position.

Such an actuator is known in many embodiments, as in amongst others the Dutch patent No. 174.580. The resetting spring means shown therein are embodied as one pressure spring present between an end wall and a piston, which spring forces the pistons through their coupled movement into a rest position which corresponds with the smallest possible distance between the pistons. The disadvantage of the use of such springs is that because of the nature of their spring characteristic they exert a greater backward driving force or resetting force on the pistons as compression increases. In the case of closing a valve with resetting spring means this can result in the valve being not entirely or at any rate not sufficiently reliably closed, which is impermissible for many applications. Use is often made therefore of a number of pressure springs disposed adjacent to each other. The drawback of such an arrangement is that the springs can obstruct each other since they have to be arranged at least partly cantilevered in the space and cannot be guided by bars or the like. It will be apparent that an occasionally occurring entanglement of springs caused as a result is impermissible for reliable operation.

Should a disturbance as described above occur in a known device then an average user cannot simply replace the springs. Because these are accommodated under bias in the space available for them, a fitter needs special tools to replace the springs. In practice this means that an actuator of the known type is completely replaced as soon as a disturbance occurs of the type described. It will be apparent that this entails relatively high costs for each disturbance.

The invention has for its object to resolve the above problems by providing an actuator with the feature that the resetting spring means comprise at least one gas spring which is connected between the cylinder and a piston. The advantage of the use of a gas spring is that within relatively precise limits it delivers a constant force over a very wide area, also therefore at the end of its stroke, whereby a reliable closure of a driven valve is better assured than is the case with the use of known screw springs. A gas spring also has the advantage of being obtainable in many embodiments after relatively simple adaptations with a view to connection to a known actuator and moreover of being easy to change from outside by a simple manual operation.

In order to allow the loading on the or each piston to occur in such a way that there is no need to fear that a piston will tilt, that embodiment can be recommended in which the gas spring or gas springs grips or grip the piston such that a symmetrical force is exerted on the piston. Depending on the construction, a roughly symmetrical force can be achieved by allowing the gas springs to grip an effective central point situated in the middle of a piston.

If required, an embodiment can be chosen in which at least one gas spring is added to each of both pistons. This embodiment can have the advantage that both pistons are independently reset, unlike in a single action embodiment, where the one piston has to apply the resetting force on the other via the pinion, which causes a slightly asymmetrical loading.

For the greatest possible flexibility it can be required that the gas spring be adjustable. In this latter respect reference is made to the as yet unpublished patent application NL No. 8500831 in the name of Holland Hellas B.V., a sister company of applicant. This unpublished patent application is deemed to be enclosed with the present application by way of reference.

In order to achieve a slowing of movement at the end of the stroke while maintaining the closure force, the embodiment can serve in which the gas spring is filled partly with gas under pressure and partly with a non-compressible medium, such as oil, which results in the piston performing a slowed movement at the end of its stroke directed towards the rest position of the gas spring.

The invention will now be elucidated with reference to the drawing of several random embodiments.

In the drawings:

FIG. 1 shows a partly broken away perspective view of an actuator according to the invention;

FIG. 2 is a cross section through another embodiment;

FIG. 3 is a view corresponding with FIG. 1 of a further embodiment;

Figure 4:
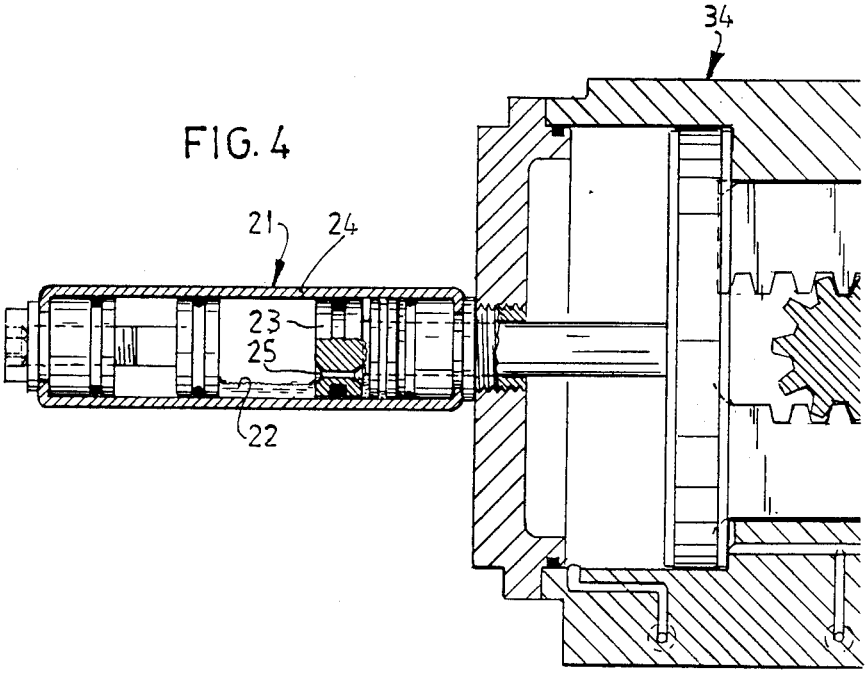
FIG. 4 shows a cross section corresponding with FIG. 2 of yet another embodiment.

FIG. 1 shows an actuator 1 which comprises an output shaft 2 coupled via a coupling unit 3 to a valve 5 arranged in a pipe 4. The actuator can be energised via a connection 6 for medium under pressure, as a result of which the angular position of the output shaft 2 and therewith the position of the valve 5 can be regulated.

Reference is first made to FIG. 2. FIG. 2 shows a cross section through an actuator 7. As can be seen from this figure, this actuator 7 comprises a cylinder 8, two pistons 9, 10 reciprocally movable in that cylinder 8, each of which carry a rack, 11 and 12 respectively, a pinion 13 placed between and connected to both racks 11, 12 and coupled to the output shaft 2. The cylinder 8 also displays a connection 6 for a medium under pressure, such as compressed air, which in the manner shown in FIG. 2 can be admitted via the connection 6 into the space which is bounded by the inner wall of cylinder 8 and the facing surfaces of the pistons 9, 10.

On the right side the cylinder 8 carries a right-hand wall 14.

A gas spring 16 is coupled to a left-hand wall 15. The plunger 17 of this gas spring is forced to the right by the action of the gas spring 16 such that it exerts a force directed to the right on the piston 9. Via the rack 12, the pinion 13 and the rack 11, a force is exerted on the piston 10 such that it performs the same movement as the piston 9 in the opposite direction. With reference to FIG. 1 it should be noted in this respect that this is an embodiment with a second gas spring 38 which cooperates with the piston 10 in the same way as the gas spring 16 with the piston 9.

The gas spring 16, 17 is of the type disclosed in the as yet unpublished patent application NL No.-8500831 already mentioned above. For this reason a detailed discussion of the gas spring 16 within the framework of the present patent application will be omitted.

The actuator shown in FIG. 2 is of the double action type. In this regard the connection 6 for medium under pressure comprises three lines 18, 19, 20. The line 18 serves for transportation of the pressure medium from and to the space between the two pistons 9, 10 while the lines 19, 20 serve for transport from and to the respective spaces to the left of the piston 9 and the right of the piston 10. In the case of a single action cylinder the line 18 is sufficient, in which case the stated left-hand space and right-hand space are preferably communicate with the surrounding environment via pressure equalising means. For example, the walls 14 and 15 can display a pressure equalising opening.

The gas spring 16 contacts at approximately the middle of the piston 9. The pressure load on the piston 9 is more or less symmetrical as a result.

FIG. 3 shows an actuator 31 which differs from the device 1 according to FIG. 1 in one respect, namely the fact that it comprises three gas springs 32 and 33 respectively on both sides.

FIG. 4 shows an actuator 34 which with regard to construction corresponds with the device 7 as in FIG. 2 but differs from it in one respect. The gas spring 16 according to FIG. 2 is filled exclusively with a gas under pressure, for example nitrogen under a pressure of several tens of bars. The gas spring 21 according to FIG. 4 also comprises, apart from gas under pressure, a certain amount of non-compressible oil 22, whereby the oil 22 has to be pressed through the narrow opening 25 at the end of the stroke of the piston 23 in the cylinder 24 causing a slowed movement of the piston 23 as a result of the viscosity of the oil 22 being higher than the viscosity of the gas.

Figure 5:
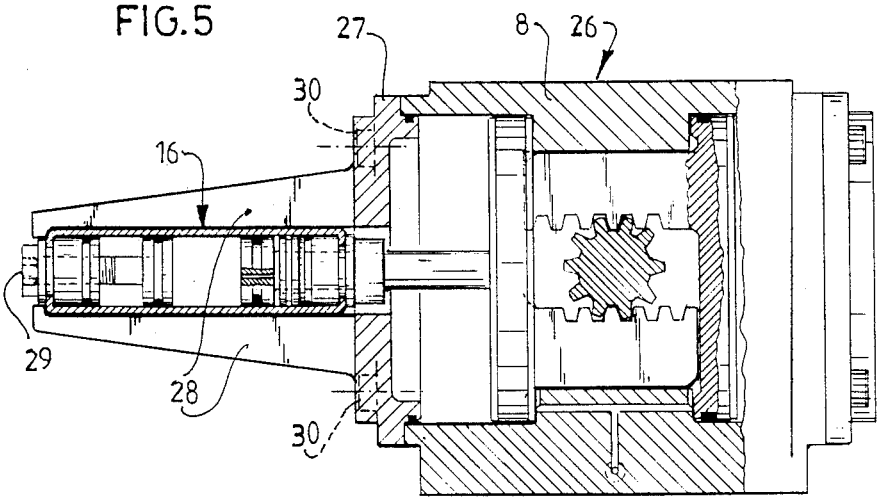
FIG. 5 is a cross section corresponding with FIG. 2 of yet another embodiment.

FIG. 5 shows an actuator 26 in which the lefthand end wall or cover 27 is embodied such that the gas spring is arranged therein. Ribs 28 serve as reinforcement. The adjusting screw 29 is serviceable from the outside to adjust the effective internal volume of a closed environment defined by the gas spring. In this embodiment the gas spring 16 can be laid in the cover 27 as a cartridge. By screwing cover 27 in position on the cylinder 8 by means of screws 30, the gas spring 16 is correctly positioned.

In one embodiment (not drawn) a cover comprises a cavity which functions as gas spring cylinder.

It will be apparent that various modifications are possible within the scope of the invention. It should be noted that the embodiments discussed above are provided with adjustable gas springs. It will however be apparent that, depending on the purpose of use, non-adjustable gas springs can also be employed.

We claim:

1. Actuator, comprising:

a cylinder, two pistons reciprocally movable in the cylinder, two racks, each carried by a respective piston, a pinion coupled to the racks, the racks diametrically opposed to each other relative to the pinion, an output connecting part coupled to the pinion for connecting a device for driving thereto, means for communicating a medium under pressure to the pistons for causing the pistons simultaneously to move away from or move towards one another, thereby causing the performing of a corresponding pivoting movement of said output connecting part, and resetting spring means for forcing said pistons to a terminal rest position, wherein said resetting spring means comprises at least one gas spring which is connected to each piston, wherein the gas spring is filled partly with gas under pressure and partly with a non-compressible medium, such as oil, so that the piston performs a slowed movement at the end of its stroke directed towards the rest position of the gas spring.

2. Actuator as claimed in claim 1, wherein the gas spring contacts the pistons such that a symmetrical force is exerted on said piston.

3. Actuator as claimed in claim 1, wherein at least two gas springs are added to each of said two pistons.

4. Actuator as claimed in claim 1, wherein the gas spring is adjustable by changing the volume of a closed environment defined by the gas spring.

5. Actuator as claimed in claim 1, wherein the gas spring is arranged in a cover connected to said at least one cylinder.

6. Actuator comprising:

a cylinder, two pistons reciprocally movable in the cylinder, two racks, each carried by a respective piston, a pinion coupled to the racks, the racks diametrically opposed to each other relative to the pinion, an output connecting part coupled to the pinion for connecting a device for driving thereto, means for communicating a medium under pressure to the pistons for causing the pistons simultaneously to move away from or move towards one another, thereby causing the performing of a corresponding pivoting movement of said output connecting part, and resetting spring means for forcing said pistons to a terminal rest position, said resetting spring means comprising at least one gas spring which is connected to each piston, wherein the gas spring is filled partly with gas under pressure and partly with a medium having a higher viscosity than the gas whereby the piston performs a slowed movement at the end of its stroke directed towards the rest position of the gas spring.

7. Actuator as claimed in claim 6, wherein the gas spring contacts the piston such that a symmetrical force is exerted on said piston.

8. Actuator as claimed in claim 6, wherein at least two gas springs are added to each of said two pistons.

9. Actuator as claimed in claim 6, wherein the gas spring is adjustable by changing the volume of a closed environment defined by the gas spring.

10. Actuator as claimed in claim 6, wherein that gas spring is arranged in a cover connected to said at least one cylinder.

11. Actuator as claimed in claim 6, wherein the higher viscosity medium is oil.

* * * * *